US008044866B2

(12) United States Patent
Weaver

(10) Patent No.: US 8,044,866 B2
(45) Date of Patent: Oct. 25, 2011

(54) OPTICALLY RECONFIGURABLE RADIO FREQUENCY ANTENNAS

(75) Inventor: Thomas L. Weaver, Webster Groves, MO (US)

(73) Assignee: The Boeing Company, Chicago, IL (US)

( * ) Notice: Subject to any disclaimer, the term of this patent is extended or adjusted under 35 U.S.C. 154(b) by 1022 days.

(21) Appl. No.: 11/936,056

(22) Filed: Nov. 6, 2007

(65) Prior Publication Data

US 2011/0180661 A1 Jul. 28, 2011

(51) Int. Cl.
*H01Q 1/26* (2006.01)
*H01Q 1/28* (2006.01)

(52) U.S. Cl. ..... 343/701; 343/705; 343/708; 343/912

(58) Field of Classification Search ..... 343/701, 343/705, 708, 909, 912
See application file for complete search history.

(56) References Cited

U.S. PATENT DOCUMENTS

| | | | | |
|---|---|---|---|---|
| 4,605,281 | A | 8/1986 | Hellewell | |
| 4,807,959 | A | 2/1989 | Berkey | |
| 5,249,246 | A | 9/1993 | Szanto | |
| 5,262,796 | A | 11/1993 | Cachier | |
| 5,822,477 | A | 10/1998 | Crouch | |
| 6,417,807 | B1 * | 7/2002 | Hsu et al. | 343/700 MS |
| 6,469,677 | B1 * | 10/2002 | Schaffner et al. | 343/876 |
| 6,963,314 | B2 * | 11/2005 | Webb et al. | 343/844 |
| 7,259,903 | B2 * | 8/2007 | Crowley | 359/328 |
| 2007/0108484 | A1 | 5/2007 | Nagamune et al. | |

FOREIGN PATENT DOCUMENTS

| | | | |
|---|---|---|---|
| EP | 1727239 | A1 | 11/2006 |
| WO | WO2007071475 | A1 | 6/2007 |

OTHER PUBLICATIONS

Chen, et al., "Ultrafast Optical Switching Properties of Single-Wall Carbon Nanotube Polymer Composites at 1.55 mu/ m", Applied Physics Letters, vol. 81, Issue 6, Aug. 5, 2002, pp. 975-977.
Durkop, et al., "Properties and Applications of High-Mobility Semiconducting Nanotubes", Journal of Physics: Condensed Matter, Topical Review, IOP Publishing Ltd., vol. 16, 2004, pp. R553-R580.
Ebbesen, et al., "Electrical Conductivity of Individual Carbon Nanotubes", Nature, vol. 382, Jul. 4, 1996, pp. 54-56.
Kim, et al., "Effect of Electric Field on the Electronic Structures of Carbon Nanotubes", Applied Physics Letters, vol. 79, No. 8, Aug. 20, 2001, pp. 1187-1189.
Li, et al., "Nano Chemical Sensors with Polymer-Coated Carbon Nanotubes", IEEE Sensors Journal, vol. 6, No. 5, Oct. 2006, pp. 1047-1051.
Lou, et al., "Fullerene Nanotubes in Electric Fields", Physical Review B, vol. 52, No. 3, Jul. 15, 1995, 1429-1432.

(Continued)

*Primary Examiner* — Hoang V Nguyen
(74) *Attorney, Agent, or Firm* — Caven & Aghveli LLC

(57) ABSTRACT

Optically reconfigurable radio frequency antennas for use in aircraft systems and methods of its use are disclosed. In one embodiment, the antenna includes a surface-conformal reflector that includes optically addressable carbon nanotubes. The nanotubes can be combined with light-sensitive materials so that exposure to light of the correct wavelength will switch the nanotubes back and forth between a metallic and non-metallic state. The antenna has a transmitter that radiates a radio frequency signal in the direction of the surface illuminator and an addressable optical conductor to illuminate the nanotubes with one or more optical signals. When the domains are illuminated they switch portions of the carbon nanotubes between its non-metallic states and metallic states to reflect the radiated radio frequency signal.

20 Claims, 4 Drawing Sheets

OTHER PUBLICATIONS

Marcus, et al., "Photo-gated Carbon Nanotube FET Devices", abstract retrieved at http://flux.aps.org/meetings/ YR04/MAR04/ baps/abs/S7590003.html>>, American Physical Society annual meeting, Montreal, Quebec, Canada, Mar. 2004, 1 pg.

Peng, et al., "Carbon Nanotube Chemical and Mechanical Sensors", Conference Paper for the 3rd International Workshop on Structural Health Monitoring, 2001, pp. 1-8.

Rochefort, et al., "Switching Behavior of Semiconducting Carbon Nanotubes Under an External Electric Field", Applied Physics Letters, vol. 78, No. 17, Apr. 23, 2001, pp. 2521-2523.

Star, et al., "Starched Carbon Nanotubes", Angew. Chem. Int. Ed., vol. 41, No. 14, 2002, pp. 2508-2512.

PCT Intl Search Report and Written Opinion for Application No. PCT/US2008/082296, dated Apr. 9, 2009, 14 pgs.

* cited by examiner

OPTICALLY RECONFIGURABLE RADIO FREQUENCY ANTENNAS

FIELD OF THE INVENTION

The field of the present disclosure relates to technology systems and methods for reconfiguring a radio frequency antenna on an aircraft, and more specifically, to optically reconfiguring a direction of an electronic signal originating from a radio frequency antenna and a reflector that is constructed using photosensitive carbon nanotubes.

BACKGROUND OF THE INVENTION

Existing solutions to thwart an electromagnetic attack of an aircraft antenna require complex and only marginally effective electronics to try to block or shunt to ground an incoming electromagnetic attack pulse. Also to control an antenna pattern that resists the attack, available methods use either fixed patterns of reflectors; or, for dynamic reconfiguration, large arrays of small antennas, each with its own transmit or receive electronics, or large arrays of small antennas, each with its own passive phase shifter. Although desirable results have been achieved using prior art systems and methods, novel systems and methods that mitigate the above-noted undesirable characteristics would have utility.

SUMMARY

Technology systems and methods in accordance with the teachings of the present disclosure may advantageously provide an antenna that is capable of being dynamically rendered insensitive to in-band high power electromagnetic attack. The technology systems have the secondary benefit of making antenna patterns dynamically reconfigurable without adding large quantities of electronics to the antennas.

In one embodiment, the system includes a surface-conformal reflector that includes a two-dimensional array of optically addressable domains of carbon nanotubes. The nanotubes can be combined with light-sensitive materials so that exposure to light of the correct wavelength will switch the nanotubes back and forth between a metallic and non-metallic state. Each domain is optically addressed to switch the state of the nanotubes. The system has a transmitter that radiates a radio frequency signal in the direction of the surface illuminator and an optical conductor to illuminate the domains with one or more optical signals. When the domains are illuminated they switch the addressable domains of carbon nanotubes between the non-metallic state and metallic state to reflect the radiated radio frequency signal. These domains can be used to produce a surface-conformal, passive array that, when used with a simple transmitter/receiver antenna, forms an effective antenna that is both steerable and frequency-agile.

In another embodiment, an aerospace assembly includes a structure and an aerospace system operatively coupled to the structure. The aerospace system includes a transmitter and a surface-conformal reflector that includes a two-dimensional array of optically addressable domains of carbon nanotubes. The domains when optically addressed result in the nanotubes switching between a non-metallic state and a metallic state. The transmitter radiates a radio frequency signal in the direction of the surface illuminator. An optical conductor is coupled to the reflector to illuminate the domains with one or more optical signals to switch the optically addressable domains of carbon nanotubes back and forth between the non-metallic states and metallic states to selectively reflect the radiated radio frequency signal.

In another embodiment, a method includes providing a surface-conformal reflector that includes a two-dimensional array of optically addressable domains of carbon nanotubes. The domains when optically addressed switch back and forth between a non-metallic state and a metallic state. A radio frequency signal is radiated from a transmitter in the direction of the reflector. The domains are then addressed with optical signals to switch the domains of carbon nanotubes between the non-metallic states and metallic states to reflect the radiated radio frequency signal in a predetermined direction.

The features, functions, and advantages that have been above or will be discussed below can be achieved independently in various embodiments, or may be combined in yet other embodiments, further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure teaches optically reconfigurable radio frequency antenna technology systems and methods. Many specific details of certain embodiments of the invention are set forth in the following description and in FIGS. 1-4 to provide a thorough understanding of such embodiments. One skilled in the art will understand, however, that the invention may have additional embodiments, or that the invention may be practiced without several of the details described in the following description. Carbon nanotubes is disclosed in this description as a material that becomes conductive when adjacent photosensitive material is illuminated, any material that becomes conductive when illuminated may be substituted for the carbon nanotubes and photosensitive material disclosed herein.

Using photosensitive carbon nanotubes makes it possible to produce a thin, lightweight patterned impedance surface, in which the pattern of metallic and non-metallic regions can be changed dynamically. This capability enables one antenna, used in conjunction with a complex surface, to change its frequency and direction of operation. As a result, one antenna can be used for many different applications and makes it possible for the antenna system to be easily conformed to the flight surfaces of a vehicle. In addition, the patterned impedance on the surface can be used to make the antenna insensitive to RF inputs during a high power RF attack.

An aircraft system is disclosed that includes antenna for either transmission or receiving. The antenna can have its electromagnetic pattern changed smoothly from omni-directional to narrow-beam, that can have the beam steered, that will be tunable in frequency of operation, that will consist of electrically passive devices, that can be shaped to conform to a surface (such as the surface of an aircraft or any vehicle), and that will be highly resistant to electromagnetic attack.

Figure 1:
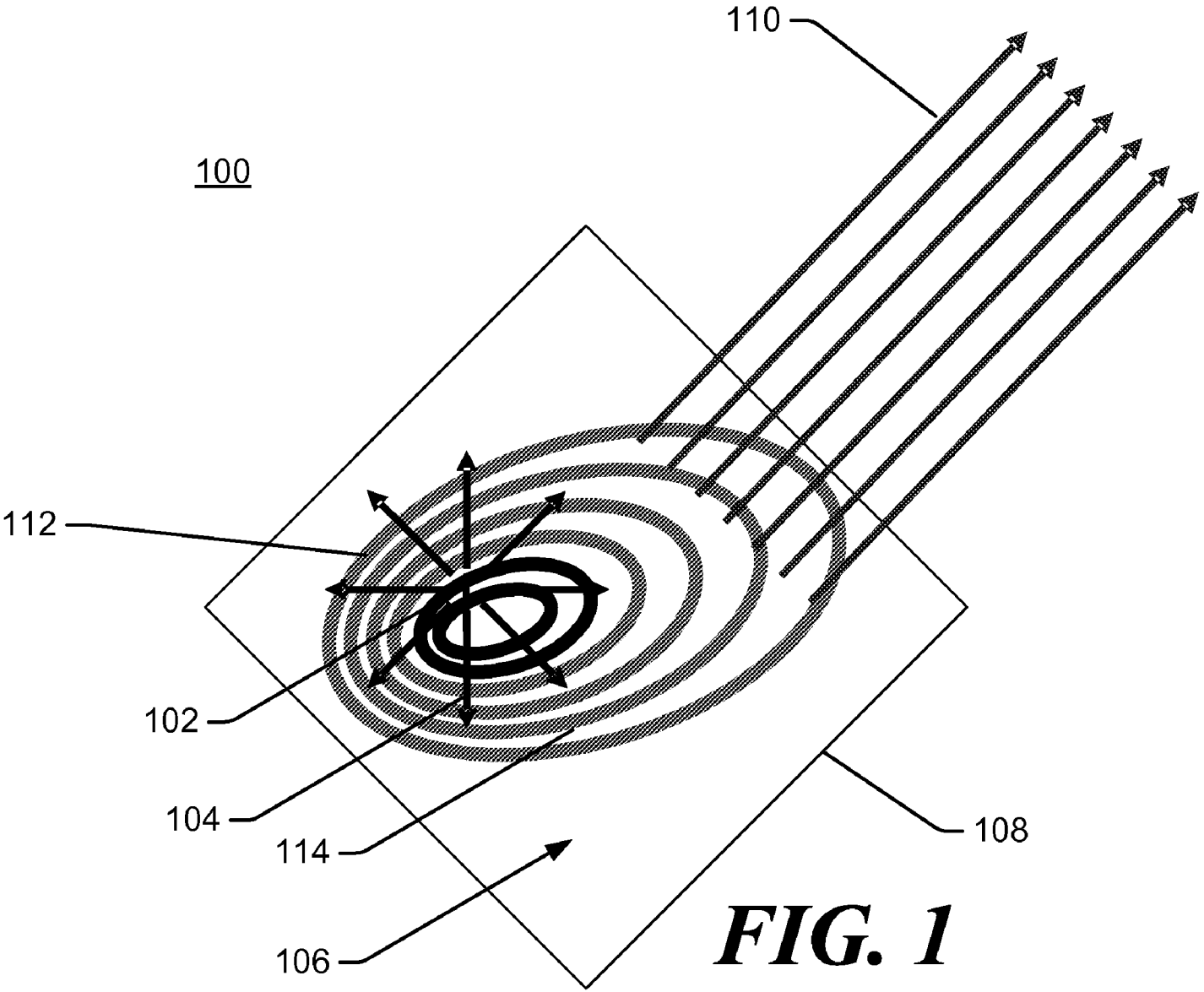
FIG. 1 is an isometric view illustrating the optically reconfigurable reflector and antenna in accordance with an embodiment of the invention.

There are two parts to the operation of the aircraft system using nanotubes. Although the system is disclosed that can be used on an aircraft, the operation and system is not limited to an aircraft, and may be used on any moving or stationary device. The first part is the holographic process by which an antenna interacts with a pattern on the surface of the nanotubes to produce a modified composite RF pattern. The second part to the operation of the system includes an interaction between optical guides illuminating light through small openings in the guides and optically addressable nanotubes that controls the reflection on the patterned surface. When the light illuminates the photosensitive material 210 attached to carbon nanotubes 208, the photosensitive material 210 builds up electrons resulting in the adjacent nanotubes acting as conductors to reflect RF signals. FIG. 1 is an exemplary diagram of how this process produces a focused beam pointed in a single fixed direction by using a small omnidirectional transmitting antenna.

In FIG. 1, system 100 has a small illuminator antenna 102 (also referred to as a transmitter herein) that emits RF energy 104 approximately uniformly in all directions. The emitted energy illuminates the space above and onto the surface 106 of a surface conforming reflector 108. If surface 106 is a non-conducting material, the emitted energy 104 from antenna 102 would pass through surface 106. If surface 106 is constructed of an electrically conducting material, such as a metal, the emitted energy 104 would become reflected energy 110. If the energy 104 is reflected, that reflected energy 110 would combine with the energy 104 emitted directly from the antenna 102 to produce a (relatively) simple pattern of circular regions of high and low RF intensity.

In system 100 being described herein, the surface 106 is a mixture of patches of conductive 112 and non-conductive 114 regions of carbon nanotubes attached to an aircraft shell. The patches 112 become conductive when an optical signal illuminates the patch 112. The interaction between the energy 104 directly transmitted from the antenna 102 and the energy 110 which reflects off the various conductive patches 112 (also referred to herein as a pattern surface) can be structured to produce an outgoing beam of reflected energy 110 focused in one direction. Patches 112 are individually addressable using optical signals as described herein to selectively enable a portion of patches 112 to become conductive. Moreover, patches 112 are individually addressable using optical signals as described herein to selectively disable a portion of patches resulting in the disable patch being non-conductive. This change in conduction of the patches 112 resulting in a change in the direction or reflection of the RF signal from the antenna 102.

This reflection and combining process works equally well in reverse if antenna 102 is a receiving antenna. If a surface 106 that converts an omnidirectional transmission into a tight beam going out along some axis is exposed to a tight beam coming in on that axis, the reflections of the incoming tight beam off the patterned surface 112 will interact with parts of the beam that have not hit the surface to produce an omnidirectional signal directed at the antenna 102. Since an antenna 102 producing omnidirectional signals being transmitted will also be sensitive to omni-directional signals being received, the antenna 102 will detect the incoming signal that is transmitted in a tight beam.

Figure 2:
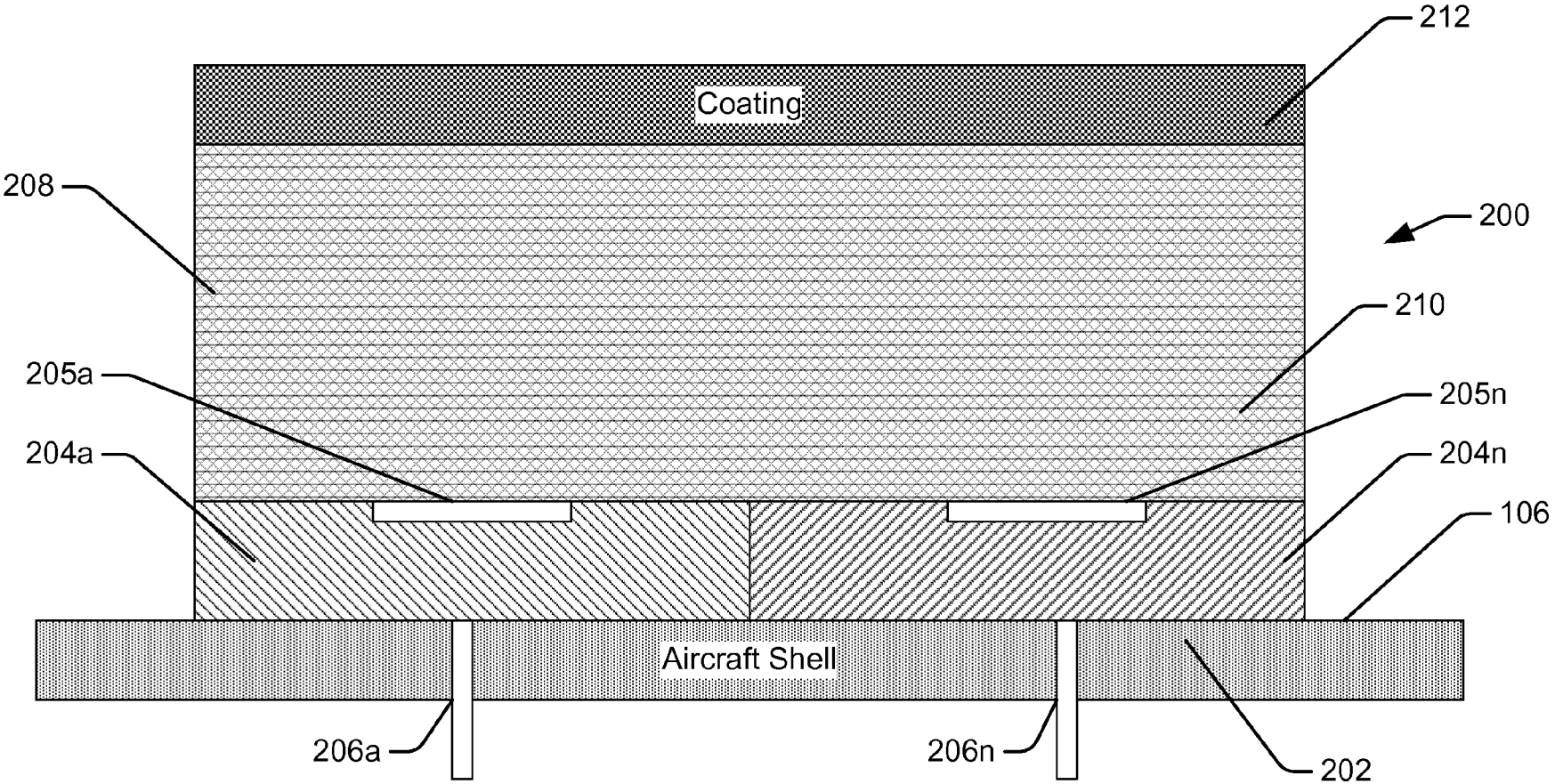
FIG. 2 is an enlarged cross-sectional view of the optically reconfigurable reflector of the system of FIG. 1.

A reflector 200 is shown in FIG. 2 coupled with an aircraft shell 202 of an aircraft. The aircraft shell 202 is attached to structural portions of the aircraft that has a surface 106 that is coupled through an array of optical media **204*a*-204*n* (such as optical guides) to a two-dimensional array of many small domains of carbon nanotubes/photo-sensitizers 208 (shown as horizontal lines in FIG. 2), with each region or domain being individually optically addressable. Optical media 204*a*-204*n* may be supplied with a light signal via optical fibers 206*a*-206*n*. Disposed adjacent media 204*a*-204*n* coupled with carbon nanotubes 208 is photosensitive material 210 (shown as crosshatched lines in FIG. 2). A covering carbon nanotube 208 is coating 212 that may be used to protect the carbon nanotubes 208** from the environment.

Using the array of optical fibers **204*a*-204*n*, a surface with a pattern of varying conductivities could be created by sending optical signals of different intensities to each of the regions of carbon nanotubes 208. Furthermore, by changing the number and location of optical signals applied to the regions, the pattern of conductivity of the surface could be changed. By changing the orientation of the pattern, the direction in which an antenna 102 is active could be altered. By raising and lowering the number of contiguous regions that have the same conductivity, the size scale of the pattern could be increased and decreased. This would shift the frequency of operation of the system to lower and higher frequencies. Finally, if the antenna 102 were to pick up a steeply rising RF input signal, logic circuits fed by the antenna 102** could infer that the system is under high power electromagnetic attack and could direct the optical controller to command all the regions to the low conductivity state or change the direction of the RF signal from the system. This in turn would make the antenna/receiver system no longer have high sensitivity in the direction from which the attack came, and therefore provide the receiver its best chance of surviving the attack.

Each of the arrays of small elements contains large numbers of carbon nanotubes 208 with either physically or chemically attached photosensitive materials 210. In turn, nanotubes 208 are addressed by optical signals, which are used to control the switching of the nanotubes back and forth between their metallic and non-metallic states. Optical media **204*a*-204*n* may have openings 205*a*-205*n* in which the optical signal may emanate through to illuminate photosensitive material 210. The elements of nanotubes are arranged in an array on a surface which may be flat or have a complex configuration. The nanotubes 208** may be physically or randomly aligned.

Located within or somewhere on the edge of the array of elements is a simple radio frequency antenna 102 described in FIG. 1. The interaction of the simple RF field from the antenna 102 with the reflection of that field from the surface array produces a final RF field pattern that can be shaped and steered while the RF system is in use. By controlling the elements of the array to work together in groups, the array can also be made to operate over a range of RF frequencies. Control of the elements will employ optical signals to the elements that are capable of individually addressing each element, and suitable for the structure in which the reconfigurable antenna system is to be used. If the carbon nanotubes 208 in the domains are physically aligned, rather than randomly oriented, activation of domains having particular nanotube orientations can exert control over the polarization of the RF signals transmitted or received.

In FIG. 2, examples of the photo-generating material 210 include photosensitive materials such as CdS and CdSe, which are well known photosensitive materials with good optical efficiencies as well as response times. As such, they are probably among the best choices. It is believed that the photo-generated charge from the CdS or CdSe acts through quantum capacitance to alter the Fermi level and thus to alter the conductivity of the carbon nanotube.

Another photo-generating technique which can be used in the present invention was disclosed at the American Physical Society annual meeting in March, 2004, in Montreal, Quebec, Canada. In a presentation at that meeting by Matthew S. Marcus et al entitled "Photo-gated Carbon Nanotube FET Devices," the ability was disclosed to use visible light from a HeNe laser to gate a single walled carbon nanotube FET (CNTFET). The transistor devices were fabricated on SiO,/p-Si substrates, where the p-Si was used as a gate for the nanotube channel. The light was absorbed not only by the carbon nanotube, producing photocurrents, but also in the silicon gate, which produced a photo-voltage at the interface between the Si and the SiO5. Changes were observed in the channel current of up to 1 nA using light to photo gate the CNTFET.

Yet another possibility is the use of photosensitive polymers ("photo-polymers"). A number of research papers have presented results and discussions of employing polymers with carbon nanotubes to create optoelectronic devices. The polymers are typically in contact with the carbon nanotubes 208 to functionalize the nanotubes, rather than being covalently bonded to the nanotubes. The charge formed when the polymer absorbs light creates a photo-voltage near the nanotube surface and modifies the nanotubes conductivity in the way that has been described above. It has been discussed that this "wrapping" of the polymer around the nanotube has advantages over covalently linking the polymer to the nanotube, because the covalent linking chemically alters the nanotube structure. Examples of creating photosensitive polymers with carbon nanotubes are described in "Starched Carbon Nanotubes" by A. Star, D. W. Steuerman, J. R. Heath and J. F. Stoddart, Angew. Chem., Int. Ed. 41 (2002), p. 2508.

Photo-polymers have interestingly large photon cross sections and the presence of the nanotube tends to inhibit the emissions of luminescence photons from a photo-polymer in favor of a charge transfer effect on the nanotube that gives rise to the modulation of the nanotubes conductivity. Rather large photo-electric gains have been reported for these polymercarbon nanotube hybrid structures, on the order of $10^5$ electron increase in the nanotube conduction for every photon absorbed by the polymer.

Another aspect to the operation of this system is the application of a recently discovered property of carbon nanotubes, which is, carbon nanotubes can be switched between conductive and non-conductive forms by means of an optical signal and subsequently used to produce a steerable directed beam.

Shortly after carbon nanotubes were discovered, it was determined that they came in many types, with a variety of properties. Of importance to this disclosure is that one of the properties which vary greatly among different types of nanotubes is electrical conductivity. A property which does not vary is the high resistance of carbon nanotubes to being affected in any way by external electromagnetic fields until the fields become very large, such as that produced by actual contact of a terminal with the nanotube. Recent measurements have indicated that exposing a nanotube to external electric fields will not alter its conductivity until the field strength approaches two million volts per meter (i.e., approximately the field strength at which the gases in the atmosphere at sea level ionize, which means that stronger fields cannot be produced in the atmosphere). Therefore, for all practical purposes, any device using carbon nanotubes that is used within the earth's atmosphere will be immune to effects from electromagnetic fields. Therefore, a pattern of regions of high and low electrical conductivity on a surface made by covering the surface with a pattern containing conductive and non-conductive carbon nanotubes will not be altered by any RF energy which impinges upon it. Additionally, the pattern will not be altered by electrical signals it is supposed to process, nor will it be affected by radio frequency weapons that might be considered to be a threat.

Even though the electrical conductivity of a carbon nanotube will not be affected by an external electromagnetic field, the conductivity can be altered by placing on the surface of a nanotube a molecule that is either electrically charged or electrically polarized. Having a charged or polarized molecule in physical contact with a nanotube alters the electron wave functions that the nanotube can support, and therefore can alter the conductivity of the nanotubes. Carbon nanotubes can be prepared in systems which have the nanotubes in contact with molecules which change their electronic states and related optical states in response to impinging light. Shining light on the nanotube-photosensitive molecule combination results in a switch that changes its conductivity in response to light, but not in response to external radio frequency electromagnetic fields.

A potentially important feature of this disclosure is that the individual regions of nanotubes can be made quite small if necessary, on the order of microns in linear dimensions. That means the patterned surfaces could be used for shaping RF transmissions in the lower terahertz frequency range. How high in frequency the surfaces could be effective would depend upon how small the regions could be made.

Figure 3:
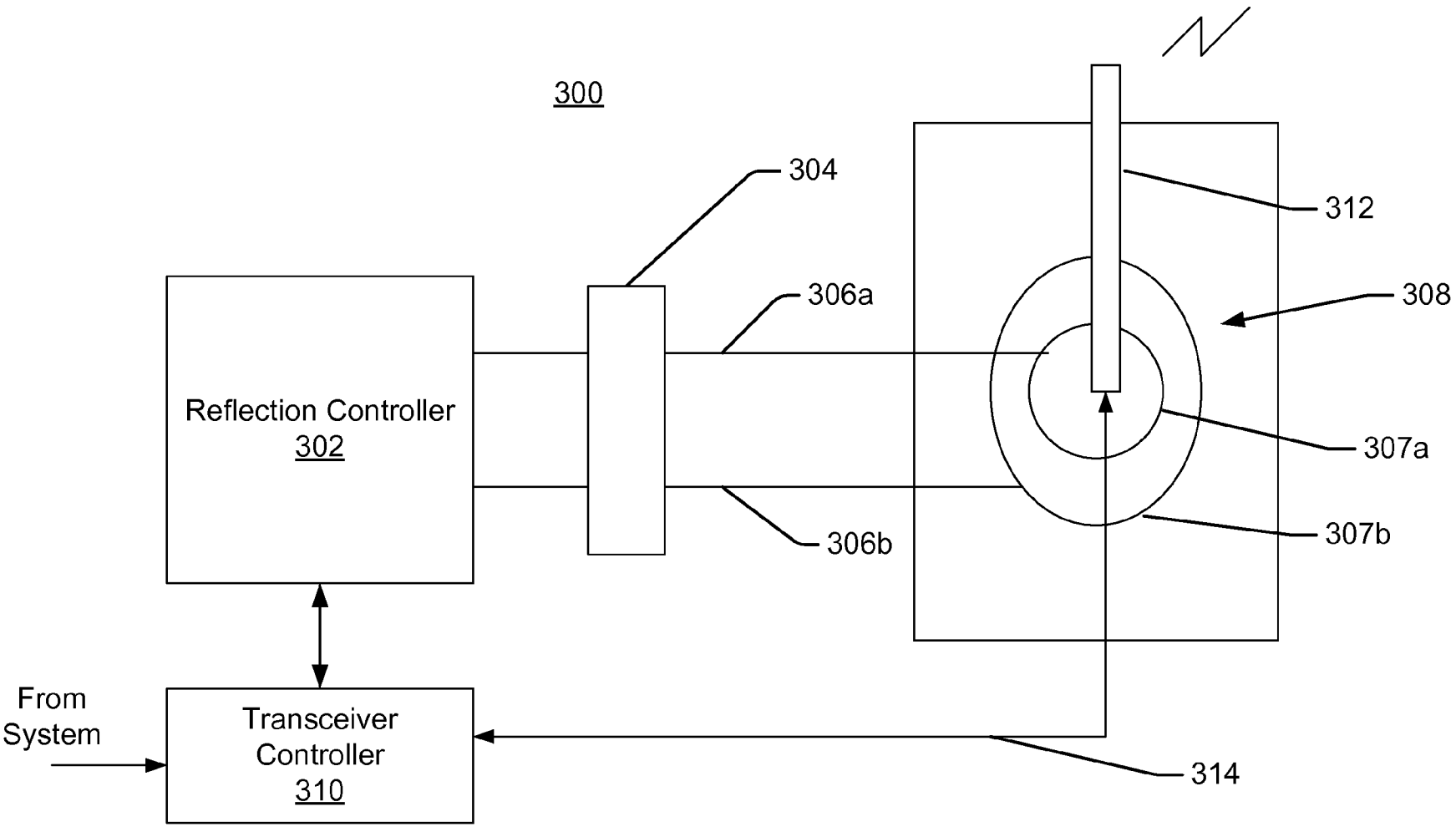
FIG. 3 is a simplified schematic diagram of the optically reconfigurable reflector and antenna for the system in FIG. 1.

Illustrated in FIG. 3 is a schematic diagram of a circuit 300 for selecting and addressing individual nanotubes to change the direction of transmission of an RF signal emanating from an antenna 102. Circuit 300 includes a reflection controller 302 coupled, via an electrical to optical transformation circuit 304 to feed optical signals through optical media 306*a* to illuminate, in a computer generated pattern 307*a*, nanotubes 308. Circuit 300 is also coupled, via electrical to optical transformation circuit 304 to feed optical signals through optical media 306*b* to illuminate, in another computer generated pattern 307*b*, another portion of nanotubes 308. A transceiver controller 310 transmits and receives RF signals from an antenna 312 via line 314. Optical transformation circuit 304 may include any device that converts electrical signals to optical signals.

Transceiver controller 310 is capable of receiving an RF signal from a system (not shown) and feeds the RF signal to antenna 312 via line 314. Transceiver controller 310 is also capable of receiving signals from antenna 312 indicating the antenna 312 is under attack, and provides the received signals to reflection controller 302.

Reflection controller 302 contains a processor and memory (not shown) or any other logic circuitry to sense when antenna 312 is under attack. Controller 302 may be inside an aircraft and feeds signals via fiber optics 206*a*-206*n* to reflector 200, as described in FIG. 2, that may be disposed on the outside of the aircraft. In response to controller 302 sensing an attack, controller 302 may selectively deactivate a first array of signals being fed to illuminate pattern 307*a* on the nanotubes 308 via medium 306*a*, and activate a second array of signals being fed to illuminate pattern 307*b* on nanotubes 308 by feeding activate signals via line 306*b*. By changing the different patterns illuminating the nanotubes, the conductive state of the nanotubes and direction of the RF signal emanating from antenna 312 can be changed.

Reflection controller 302 has processing capabilities and memory suitable to store and execute computer-executable instructions. In one embodiment, controller 302 includes one or more processors and memory (not shown). The memory may include volatile and nonvolatile memory, removable and non-removable media implemented in any method or technology for storage of information, such as computer-readable instructions, data structures, program modules or other data. Such memory includes, but is not limited to, random access memory (RAM), read-only memory (ROM), electrically erasable programmable read-only memory (EEPROM), flash memory or other memory technology, compact disc, read-only memory (CD-ROM), digital versatile disks (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computer system.

Figure 4:
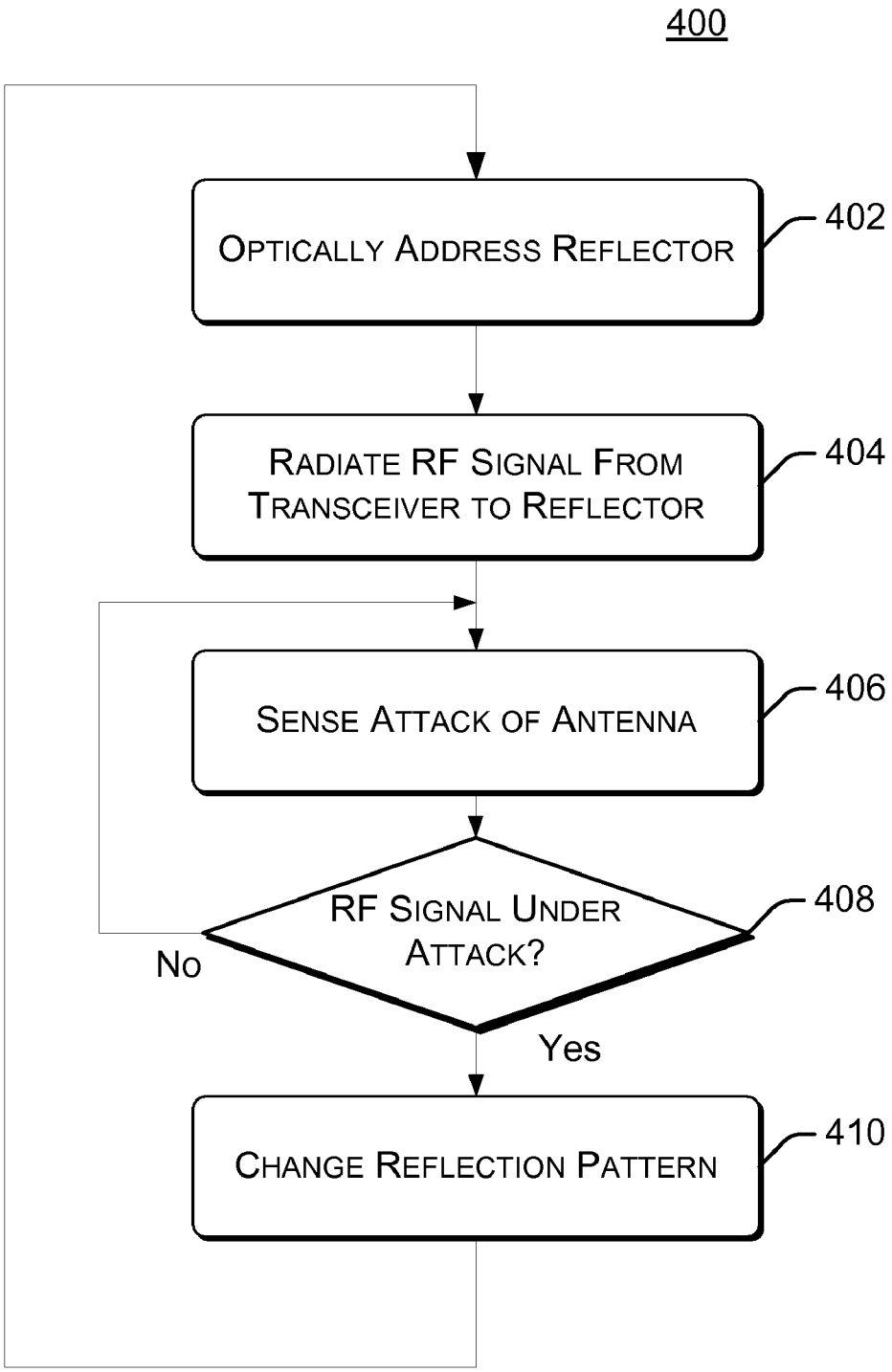
FIG. 4 is a flowchart of a method for optically configuring the direction of reflection of the antenna in accordance with another embodiment of the invention.

Illustrated in FIG. 4 is a flow diagram 400 executed by controller 302 for controlling the nanotubes to redirect the beam of RF signals from antenna 102 in the event of an attack. In block 402, the reflection controller 302 optically addresses one or more of the optical medium to illuminate computer generated patterns on the nanotubes to direct the signal originating from antenna 102 in a predetermined direction. The generated pattern of illumination may be random or computer generated. The reflection controller 302 may enable the transceiver controller 310 to feed the RF signal from the system to the antenna 102 in block 404. In another embodiment, the RF signal directly fed to antenna 102 from the system.

The reflection controller 302 then senses whether an indication of an attack has been received from transceiver controller 310 in block 406. The reflection controller 302 in block 408 determines whether an attack is occurring. If the RF signal being transmitted by antenna 102 is under attack ("yes" to block 408), controller 302 determines which optical media to activate with an optical signal to illuminate the nanotubes to form a new reflection pattern in block 410. When the new reflection pattern is formed, the direction of the RF signal from the antenna 102 or any RF signal being received by antenna 102 is changed. If the antenna 102 is not under attack ("no" to block 408), the controller 302 continues to sense whether an indication of an attack has been received from transceiver controller 310 in block 406. After determining which optical media to activate to form the new reflection pattern in block 410, the controller 302 optically activates, based on the determination, the one or more of the optical medium to illuminate the nanotubes in a computer generated pattern. In response to the nanotubes being illuminated the signal originating from antenna 102 is redirected to another predetermined direction in block 402. This redirection also results in a change of the reflection of any externally emitted RF signal attacking antenna 102.

While specific embodiments of the invention have been illustrated and described herein, as noted above, many changes can be made without departing from the spirit and scope of the invention. Accordingly, the scope of the invention should not be limited by the disclosure of the specific embodiments set forth above. Instead, the invention should be determined entirely by reference to the claims that follow.

What is claimed is:

1. A method to electronically steer an antenna's direction of radiation, the method comprising:

providing a surface-conformal reflector that comprises an array of addressable optical media that illuminate carbon nanotubes;

radiating a radio frequency signal from a transmitter in the direction of the reflector; and selectively addressing the optical media with one or more optical signals to illuminate the carbon nanotubes and switch a state of the carbon nanotubes between their non-metallic states and metallic states to alter a reflection of the radiated radio frequency signal.

2. The method as recited in claim 1 further comprising commanding the array of the optical medium to illuminate the carbon nanotubes to adopt metallic or non-metallic states in accordance with a pre-generated pattern.

3. The method as recited in claim 1 wherein the carbon nanotubes are randomly oriented on the reflector.

4. The method as recited in claim 1 further comprising coupling a plurality of optical tubes to the carbon nanotubes to illuminate the carbon nanotubes.

5. The method as recited in claim 4 wherein the carbon nanotubes are placed on a surface on the outside of an aircraft, and the optical tubes feed optical signals originating from inside of the aircraft.

6. The method as recited in claim 1 further comprising addressing a second array of optical medium to illuminate a different portion of the surface of the carbon nanotubes with light to switch the carbon nanotubes between their non-metallic states and metallic states to change the direction of reflection of the radiated radio frequency signal.

7. The method as recited in claim 6 further comprising sensing an attack of the radio frequency signal and changing the direction of the reflection in response to the attack.

8. An aerospace system, comprising:

a surface-conformal reflector that comprises one or more optically addressable carbon nanotubes, said nanotubes when optically addressed switch between a non-metallic state and a metallic state;

a transceiver to radiate a radio frequency signal in the direction of the surface reflector or receive a radio frequency signal from the direction of the surface reflector; and an optical conductor to illuminate portions of the carbon nanotubes with one or more optical signals to switch the portions of carbon nanotubes between its non-metallic states and metallic states thereby reflecting the radiated radio frequency signal.

9. The system as recited in claim 8 wherein the carbon nanotubes have a surface including a photosensitive material that is illuminated by the conductor in pre-generated patterns.

10. The system as recited in claim 8 wherein the carbon nanotubes are randomly oriented on the reflector.

11. The system as recited in claim 8 further comprising a plurality of optical tubes optically coupled to the carbon nanotubes to illuminate one or more patterns on the nanotubes.

12. The system as recited in claim 8 further comprising a second array of optical medium to illuminate a different portion of the surface of the carbon nanotubes with light to switch the carbon nanotubes between their non-metallic states and metallic states to change the direction of reflection of the radiated radio frequency signal.

13. The system as recited in claim 8 further comprising a sensor to detect an attack of the radio frequency signal, and further comprising a control circuit responsive to the sensor to change the direction of reflection in response to the attack.

14. The method as recited in claim 8 wherein the carbon nanotubes are placed on an outer surface of an aircraft, and wherein optical conductor is optically coupled with the carbon nanotubes to feed optical signals to the carbon nanotubes originating from inside of the aircraft.

15. An aircraft assembly, comprising:

a structure; and an aircraft system operatively coupled to the structure, the aircraft system including:

a surface-conformal reflector that comprises one or more optically addressable carbon nanotubes, said nanotubes when optically addressed switch between a non-metallic state and a metallic state;

a transmitter to radiate a radio frequency signal in the direction of the surface reflector; and an optical conductor to illuminate portions of the carbon nanotubes with one or more optical signals to switch the portions of carbon nanotubes between its non-metallic states and metallic states thereby reflecting the radiated radio frequency signal.

16. The aircraft assembly as recited in claim 15 wherein the optically addressable portions of carbon nanotubes have a surface including a photosensitive material that are operative to be illuminated in pre-generated patterns.

17. The aircraft assembly as recited in claim 15 wherein the optically addressable carbon nanotubes are randomly oriented on the reflector.

18. The aircraft assembly as recited in claim 15 further comprising a plurality of optical tubes optically coupled to the carbon nanotubes to illuminate portions of the nanotubes.

19. The aircraft assembly as recited in claim 15 further comprising a second array of optical medium to illuminate a different portion of the surface of the carbon nanotubes with light to switch the carbon nanotubes between their non-metallic states and metallic states to change the direction of reflection of the radiated radio frequency signal.

20. The aircraft assembly as recited in claim 15 further comprising a sensor to detect an attack of the radio frequency signal, and further comprising a control circuit responsive to the sensor to change the direction of reflection in response to the attack.

* * * * *